US012220005B2

(12) United States Patent
Binder et al.

(10) Patent No.: US 12,220,005 B2
(45) Date of Patent: Feb. 11, 2025

(54) UPPER GARMENT WITH A ONE-PIECE BACK PART

(71) Applicant: Blaser Group GmbH, Isny (DE)

(72) Inventors: Andreas Binder, Jettingen (DE); KeHai Truong-Spiess, Kissleg (DE)

(73) Assignee: Blaser Group GmbH, Isny (DE)

( * ) Notice: Subject to any disclaimer, the term of this patent is extended or adjusted under 35 U.S.C. 154(b) by 137 days.

(21) Appl. No.: 17/875,705

(22) Filed: Jul. 28, 2022

(65) Prior Publication Data

US 2023/0032200 A1 Feb. 2, 2023

(30) Foreign Application Priority Data

Jul. 29, 2021 (DE) ..... 10 2021 119 767.8

(51) Int. Cl.
*A41D 1/04* (2006.01)
*A41D 31/18* (2019.01)

(52) U.S. Cl.
CPC ..... *A41D 1/04* (2013.01); *A41D 31/18* (2019.02); *A41D 2600/10* (2013.01)

(58) Field of Classification Search
USPC ..... 2/85, 125
See application file for complete search history.

(56) References Cited

U.S. PATENT DOCUMENTS 2,035,377 A * 3/1936 Redmond ..... A41B 9/06 2/125
4,473,908 A 10/1984 Knecht
4,939,844 A * 7/1990 Fujimura ..... A41H 3/00 33/12
6,202,216 B1 * 3/2001 Watanabe ..... A41D 1/04 2/243.1
6,353,934 B1 3/2002 Tada
2006/0162043 A1 * 7/2006 Angus ..... A41D 13/0518 2/113
2007/0271671 A1 * 11/2007 Okajima ..... A41D 1/04 2/69

(Continued)

FOREIGN PATENT DOCUMENTS

EP 1441054 A1 7/2004
GB 2589533 A * 6/2021 ..... A41D 1/04
WO 2013/015325 A1 2/2015

OTHER PUBLICATIONS

Result of Examination Report for German Patent Application No. 10 2021 119 767.8, filed Jul. 29, 2021.

*Primary Examiner* — Jameson D Collier
*Assistant Examiner* — Matthew R Marchewka
(74) *Attorney, Agent, or Firm* — Paul D. Bianco; Stephen Bongini; Fleit Intellectual Property Law

(57) ABSTRACT

A short- or long-sleeved upper garment with a high degree of freedom of articulation is provided, in particular for the sport shooting and hunting sector. The upper garment has a one-piece back part with a vertical central area covering the back and the shoulder area of a person. The back part has laterally left and right projecting arm sections respectively with a top side with a laterally outer end point and a bottom side with a laterally outer end point. The laterally outer end points of the left and right top sides respectively coincide with the end points of the left and right bottom sides respectively.

17 Claims, 5 Drawing Sheets

(56) References Cited

U.S. PATENT DOCUMENTS

| | | | | |
|---|---|---|---|---|
| 2013/0212769 | A1* | 8/2013 | Lubets | A41D 13/0015 2/69 |
| 2016/0235126 | A1* | 8/2016 | Roscoe | A41D 1/04 |
| 2017/0290382 | A1* | 10/2017 | Arnold | A41D 13/0015 |
| 2019/0309450 | A1* | 10/2019 | Gretton | A41D 7/00 |

* cited by examiner

UPPER GARMENT WITH A ONE-PIECE BACK PART

FIELD OF THE DISCLOSURE

The disclosure relates to an upper garment.

BACKGROUND

From the state of the art, upper garments adapted especially for sporting purposes are known, which are intended to provide their wearer with increased freedom of movement and improved wearing comfort.

From U.S. Pat. No. 6,353,934 B1, for example, long and short sleeved polo shirts for golfers are known which have a front part, a left and a right side part, a left and a right upper arm part and a one-piece back part. The side parts form connecting pieces between the front part and the back part, i.e. they cover the body flanks of the wearer, and they further extend from a left and right armhole, respectively, on an inner side of the sleeve to a sleeve end. The back part of the upper garments shown in U.S. Pat. No. 6,353,934 B1 has arm sections integral with the back part, which project laterally outwards from a central area of the back part and, similar to a Raglan sleeve, form an upper arm shell overlapping forwards (ventrally) around the upper arm and shoulder. This design is intended to achieve a high degree of freedom of movement, especially for typical golfing movements.

SUMMARY

Against this background, one aspect of the disclosure relates to improving the upper garments known from the prior art in an advantageous manner for other purposes. In particular, the objective is to specify an upper garment for sport shooting and hunting which has the least possible impairment of the shooter when handling a weapon.

In one embodiment, an upper garment includes a front part, a left and a right preferably strip-shaped side part, a left and a right upper arm part and a one-piece back part with a vertical central area covering the back and the dorsal shoulder area of a person, wherein the back part has laterally left and right projecting arm sections, each having a top side for connection to the left and right upper arm parts, respectively, and a bottom side for connection to the left and right side parts, respectively. The left and right top sides of the arm sections have a laterally inner starting point located at the central area of the back part and a laterally outer end point away from the central area. The left and right bottom sides of the arm sections also have a laterally inner starting point at the central area of the back part and a laterally outer end point away from the central area. The upper garment is characterized by the fact that the laterally outer end points of the left and right top side respectively coincide with the end points of the bottom side.

The top sides converge with the bottom sides at a common end point in each case, so that the arm sections taper in the lateral/outward direction. Depending on the position of this end point as well as the exact course of the left or right top side and the bottom side of the left or right arm section, the freedom of articulation of a shoulder, an upper and/or a lower arm can be advantageously influenced. The tapered shape of the arm sections can decouple the back part from the rest of the upper garment so that arm and/or shoulder movements introduce little or no tension into the back part. Wrinkles in the back part can also be prevented or at least reduced by this.

The arm sections are formed in such a way that they extend so far in the lateral direction that they cover a not insignificant rear part of the upper arms of a person wearing the upper garment. When the person wearing the upper garment is viewed frontally from behind, the arm sections thus extend substantially beyond the lateral boundary of the person's upper body or the lateral boundary of the back part, i.e. they have a substantial lateral extension.

Arm sections with coinciding end points of an upper and a bottom side of the arm section ending in an armhole or near the armhole are outside the scope of the invention, as they do not increase the freedom of articulation in the upper arm.

Substantial lateral extension means in particular that the arm sections have a lateral extension which is at least ⅓ of the length of an upper arm of the person wearing the upper garment. The lateral extension can be ⅖, ½, ⅔ or ⅚ of the length of the upper arm. For a typical upper arm length of 30 cm, the arm sections thus have a lateral extension of 10 cm or more, in particular 12 cm, 15 cm, 20 cm or 25 cm.

Lateral extension is the furthest horizontal distance between the starting point and the end point of the bottom side of the arm section. In the case of a horizontally running bottom side of the arm section, the lateral extension then corresponds, for example, to the length of the bottom side of the arm section.

The coinciding end points of the top or bottom sides of the arm sections preferably lie on a back side of the upper arm associated with the arm section, the end points being at a distal length of the upper arm which is between ⅓ and ⅚, preferably ⅖, ½ or ⅔, of the length of the upper arm.

Further features and advantageous embodiments will be apparent from the claims and the following description.

The term "upper garment" as used herein refers to long or short sleeved garments for covering the upper part of a person's body. It can be underwear, outerwear or weatherproof functional clothing. The upper garment may be made of textile or non-textile materials or a mixture thereof.

Terms such as side (bottom side, top side, etc.) and edge (outer edge, top edge, etc.) as used herein are to be understood as synonymous and refer to the outer edges of a flat cut or of an e.g. multilayer cut composite (with pockets, zips, inner lining, etc.) for the manufacture of the upper garment. The description of the edges indicates the cut guidance or cutting pattern which is essential for the invention. Sides/Edges of parts of the upper garment are joined in any suitable manner, preferably by sewing or gluing.

The directional indications used in the text refer to the usual anatomical directional indications for a standing person with arms hanging loosely at the side. These directional indications are to be applied mutatis mutandis to the upper garment.

In an advantageous embodiment, the central section of the back part may be divided into lower area and an upper area, the left and right arm sections being arranged laterally to the left and right of the upper area respectively. The lower area is laterally bounded by a left or right substantially vertical long side, and forms that region of the upper garment which, when worn, covers the lower back of the wearer. It may end at the lower (caudal) end, for example, with a waistband. The upper area may be bounded at the upper end by a left and right shoulder line and a neckline and extends laterally approximately as far as the lower area, so that, when worn, the upper area covers a shoulder and neck region, i.e. the dorsal area of a shoulder girdle of the wearer. The upper area then approximately forms a rectangle that extends in a vertical direction approximately from the axle holes to the shoulder line, i.e. the upper end of the back, and in a lateral direction approximately from the left to the right axle hole.

The arm sections may extend only over a section or over the entire height (height in caudal-cranial direction) of the upper area (so that in the latter case the laterally inner starting points of the upper or bottom side of the arm sections substantially coincide with the vertical beginning or end of the upper section of the central area of the back part). The arm sections thus extend in the caudal direction substantially no further than to the level of an armhole.

This can reduce tensile stress in the back part and thus reduce strain on the wearer's body when the upper body is bent or twisted. Furthermore, a more figure-hugging cut is made possible without affecting the freedom of articulation.

It is particularly advantageous if the left or right starting point of the top side of the arm section of the back part lies substantially at the left or right end points of a right and left shoulder line. Shoulder line means the contour of the back part which appears in a frontal projection of the upper clothing in the worn state as the outer contour or projection line of the shoulders. The end points of the shoulder line thus coincide approximately with the anatomical position of the shoulder joints. In one embodiment, the shoulder line may also represent the upper end of the back part. In other embodiments, the back part may be extended by collar parts and/or, as will be described below, shoulder flaps.

Due to the seamless connection of the arm sections to the central section, the back part can follow all movements of a shoulder, especially of a shoulder blade, without tension.

It is advantageous if the laterally inner starting point of the bottom sides, seen in lateral direction, is approximately at the same height as the laterally inner starting point of the top side, so that the inner starting points of the top and bottom sides each lie on a common vertical line.

Expediently, the left and right top side of the arm sections can have a dorsal and/or arched course. Dorsal means that the top sides of the arm sections do not change to the front side (ventral) of the upper garment. An arc-shaped course means a soft, kink-free course of the top side without sharp changes of direction. The curved shape of the top side also allows it to be stretched and elongated with little effort, e.g. by gradually increasing the radius of curvature of the top side (i.e. 'flattening' the curve).

It is also advantageous if the top sides of the left and right arm sections are convex, i.e. slope downwards (caudally) in a proximal-distal direction. This is particularly advantageous for the arm movements typical for the use of a long gun, i.e. movements in which the shoulder and the upper arm are moved backwards and the forearm is bent forwards.

However, the top side can also be concave or ascending in the proximal-distal direction. This is advantageous, for example, for a lateral upward movement of an arm (upward movement of the arm in a frontal plane), especially for sports such as handball or volleyball, where the arms are often moved upwards in an extended position.

By means of a curved and in particular convex design of the top side, the top side or a seam formed with the top side can thereby be used as a force conductor, so that forces acting on the upper garment during movement or bending of an arm can be dissipated via the arm sections along the top sides of the arm sections, so that the central region of the back part and thus the entire back of the wearer experiences no or only little tension. This can improve the wearing comfort of the upper garment, e.g. when a weapon is worn for a longer period of time. Furthermore, seams which always cause stiffening of the garment transversely to the seam can advantageously be moved to less disturbing places and the course of the seam can advantageously be moved along the natural (anatomical) lines of movement or flexion of a shoulder or arm.

In order to reduce tensions in arm holes of the upper garment—by arm hole is understood as the transition from the piece of the upper garment covering a torso to the area of the upper extremities/the arms—it is advantageous if the undersides of the left and right arm section have a substantially straight, and particularly preferably a horizontal course—when taking the non-processed back part before sewing (the flat blank e.g. made of a flat textile). Horizontal course in this context can also mean that the bottom side of the left or right arm section encloses an angle of 90°=10°, preferably 85°+5°, with the left or right long side of the central section.

It may be useful to limit the lateral extension of the arm sections, in particular in such a way that the left or right bottom side of the arm sections do not extend distal-dorsal further than into an elbow region, i.e. approximately to the proximal-distal 'height' of the anatomical position of an elbow or before, and preferably below the elbow (below in this context means below the humerus, i.e. medially). By leaving the elbow area free, tensile stresses can be prevented from arising or being transmitted to the back part when bending the forearm. Minor elongation states or tensile stresses can be transferred to the shoulder of the wearer along the shoulder line via the left or right upper arm part and dissipated.

In a preferred embodiment, the left and right top sides respectively form the elbow region pre-shaping seams (by stitching with parts adjoining the top and bottom sides). Alternatively or additionally, the top and bottom sides may also have additional seams preforming the elbow region, for example in the form of seams contracting the material at certain points. In this way, a three-dimensional design can be created before processing into an upper garment, or the arm section can be given a desired 3D shape.

To increase wearing comfort, the back part can additionally be provided with a left or right shoulder flap for connection to the front part. Each shoulder flap extends in a lateral direction over the length of the left or right shoulder line, i.e. between the end point of the shoulder line and a collar cut-out, and extends ventrally forwards, for example to the level of the anatomical position of a collar bone. This allows the upper garment's own weight to be distributed generously over the wearer's shoulders. In addition, seams in the shoulder and neck area and thus potential pressure points can be avoided.

The aforementioned parts of the upper garment may be blanks. However, "part" is also understood to mean any other pre-processed semi-finished product in which, for example, several textile or non-textile layers have been processed, pockets or zips have been incorporated or other modifications have been made to a blank. With the exception of the one-piece back part, all other parts can be made in one piece or in several pieces, especially composed of several sub-parts.

In an expedient embodiment, the aforementioned parts may be configured and assembled—i.e. sewn, glued or otherwise joined—to form an upper garment, as follows.

The front part has a laterally left and right, vertically extending, outer side, and the right or left side part has a ventral and a dorsal, preferably vertically extending long side, whereby a first subsection of the ventral long side of the side part extending to an armhole or armhole line is connected to a lower section of the outer side of the front part, and whereby a first subsection of the dorsal long side of the side part extending to an armhole or armhole line is connected to the long side of the back part.

The left and right upper arm parts each have a first outer edge which is preferably connected to the top side of the left and right arm sections respectively over the entire length of the upper arm part.

The left and right upper arm parts each have a second outer edge which attaches to a laterally inner first end of the first outer edge, and which is connected to an upper subsection of the outer side of the front part.

The left and right upper arm parts each have a third outer edge which attaches to the other end, the second end, of the second outer edge, the third outer edge running backwards (ventrally) and being connected to a ventral-proximal subsection of the ventral long side of the side part, so that the left and right upper arm parts embrace an outer side of the wearer's left and right upper arm respectively.

The corresponding upper garment forms a basic structure for an upper garment with short or long sleeves with high freedom of articulation in the shoulder and arm area, the sleeves of which can be completed in different ways.

In one embodiment with long sleeves, the upper garment is provided with a left and right long sleeve, respectively, each long sleeve comprising a laterally inner (medial) inner sleeve and an outer (lateral) outer sleeve, and the left and right side part, respectively, being so long in the longitudinal direction that the side part extends to a sleeve end and forms the entire inner sleeve. This allows a high degree of freedom of movement when lifting the arm in a frontal plane (i.e. in a plane of a longitudinal section), as there are no transverse seams in the inner sleeve of the upper garment which would interrupt the flow of force when lifting the arm.

The outer sleeve is formed from the upper arm part, the arm section of the back part and a lower arm part, the lower arm part having a first, a second, a third and a fourth Edge, and the first Edge of the lower arm part forming a sleeve end which, together with the sleeve end of the side part, forms a sleeve band.

The second edge of the lower arm part is connected to a distal subsection of the ventral long side of the side part and the third edge of the lower arm part is connected to a distal subsection of the third outer edge of the upper arm part. Finally, the fourth Edge of the lower arm part is connected to a distal end section of the dorsal long side of the side part. Furthermore, the upper arm part has a fourth outer edge which is connected to a subsection of the dorsal long side of the side part.

It is particularly advantageous if the left or right upper arm part is designed in such a way that it extends from proximal to distal and at the same time winds from ventral to distal in such a way that the upper arm part covers the biceps, the elbow area and the outer forearm of the wearer. This allows the upper arm part to follow the natural flexion line of an arm during flexion or extension, while the remaining parts of the sleeve, i.e. the lower arm part, the arm section of the back part and the section of the side part forming the inner sleeve, remain substantially free of stress.

In an alternative embodiment, the upper garment is a short-sleeved upper garment having a left and right short sleeve, each short sleeve comprising an inner medial inner-sleeve and an outer lateral outer-sleeve. The right or left inner sleeve is formed by the right or left side part, analogous to the above-mentioned long-sleeved version.

The outer sleeve is formed by the upper arm part and the arm section of the back part, whereby the right or left upper arm part has a fourth outer edge opposite the first outer edge, which together with the sleeve end of the side part forms a cuff. This allows the upper garment to follow the movement of an upper arm without a cuff cutting into the flesh of an upper arm.

For an additional increase in the wearing comfort of the upper garment, it is advantageous if at least one of the parts is stretchable in at least one or two directions, i.e. made of a 2-way stretch material or a 4-way stretch material. This allows for more figure-hugging cuts. A 2-way stretch material may be, for example, a woven fabric with weft and warp yarns, in which the weft yarns are made of a highly elastic material compared to the warp yarns of the fabric, so that the fabric can be stretched highly in the direction of the weft yarns (main stretch direction), while the fabric has no or only little elasticity transversely thereto, i.e. in the direction of the warp yarns.

As an alternative to highly elastic threads, however, mechanically pre-stretched threads can also be used to produce a 2-way stretch material by crimping or twisting. Such a 2-way stretch material is commonly known as "mechanical stretch". A mechanical stretch material is lighter in weight than a 2-way stretch material with e.g. elastane yarns.

In an appropriate embodiment, the back part may be made of a 2-way stretch material, with the main stretch direction of the back part being lateral, so that the back part and especially the arm sections can follow a forward movement of a shoulder by stretching.

Additionally or alternatively, the upper arm part can be made of a 2-way stretch material, whereby the 2-way stretch material is oriented in such a way that the main stretch direction is proximal-distal. This allows the upper arm part to adapt particularly well to the forearm by stretching or shortening when the forearm is flexed or extended.

Furthermore, it may be advantageous if the left or right side part, respectively, is made of a 2-way stretch material, with the main stretch direction oriented in the longitudinal direction of the side part, i.e. caudal-cranial or proximal-distal, respectively.

In a preferred embodiment, substantially all parts of the upper garment are preferably made of one fabric. The parts can be cut, for example, transversely to the weaving direction or also obliquely at an angle of 45° to the weaving direction (so-called oblique cut). A diagonal cut makes it possible to increase the stretchability of the processed fabric.

BRIEF DESCRIPTION OF THE DRAWINGS

The invention is described below by way of example using the embodiments shown in the accompanying figures. Further advantageous embodiments and features of the invention result from the description of the figures.

They Show.

DETAILED DESCRIPTION

Figure 1A:
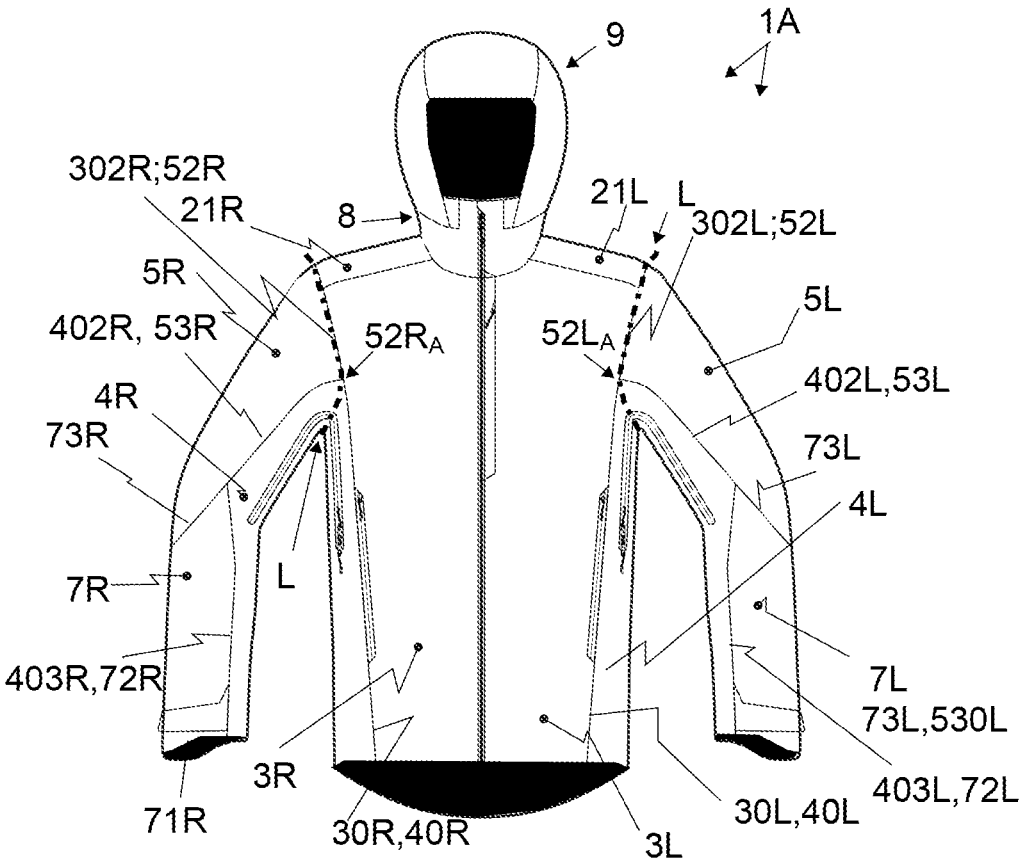
FIG. 1A a first example of an upper garment as a jacket according to the invention in a front view, FIG. 1B the upper garment of FIG. 1A in a rear view, FIG. 2A a back part of the upper garment of FIGS. 1A and 1B as a blank according to the invention, FIG. 2B a front part of the upper garment of FIGS. 1A and 1B as a blank, FIG. 2C left and right side parts, upper arm parts, and lower arm parts of the upper garment of FIGS. 1A and 1B as a blank, FIG. 3A a second example of an upper garment according to the invention in the form of a short sleeved polo shirt in a front view, and FIG. 3B the upper garment of FIG. 3A in a rear view.
Figure 1B:
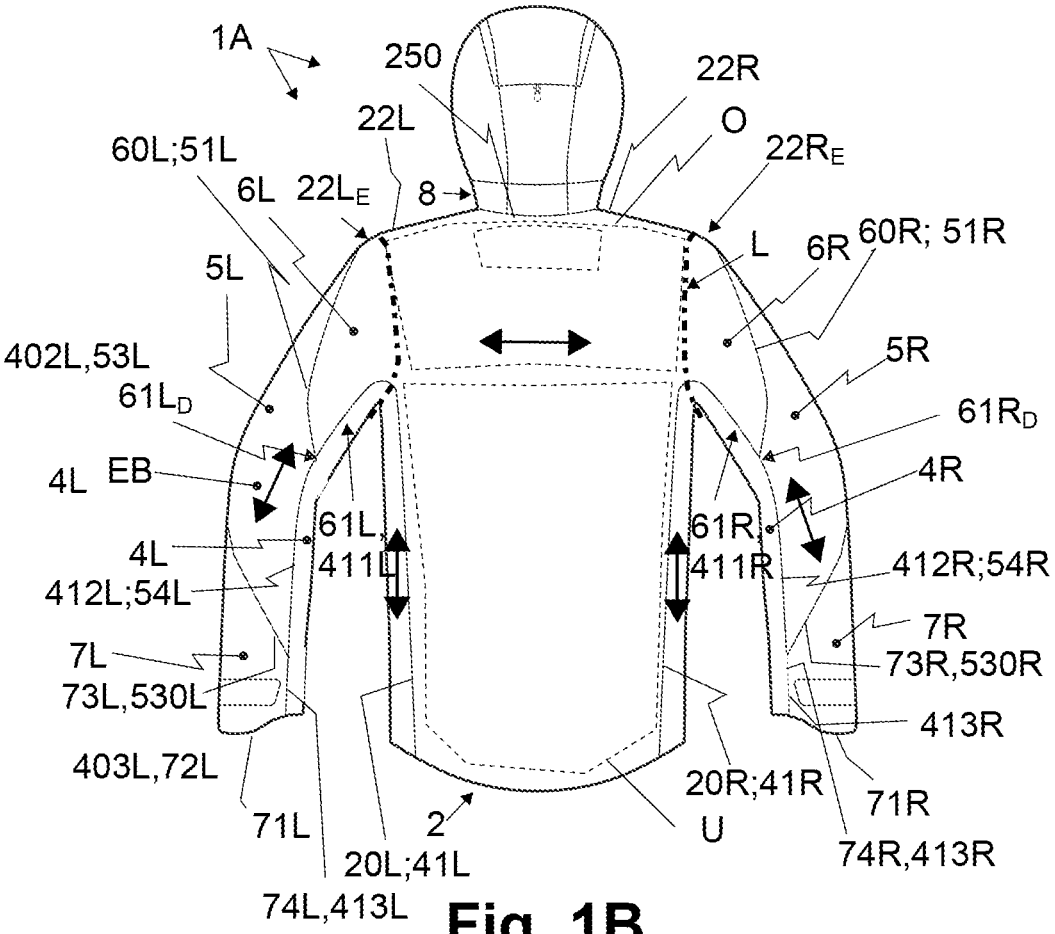

FIGS. 1A and 1B show a front and rear view, respectively, of an upper garment 1A according to the invention. The upper garment is a weatherproof hunting jacket composed of several parts. It consists substantially of a one-piece back part 2, a two-piece front part 3 connected by a zipper with a left and a right half 3L and 3R, two side parts 4L and 4R, a left and a right upper arm part 5L and 5R, and a left and a right lower arm part 7L and 7R, respectively. The hunting jacket also has a collar 8 and a hood 9 attached to it.

Figure 2B:
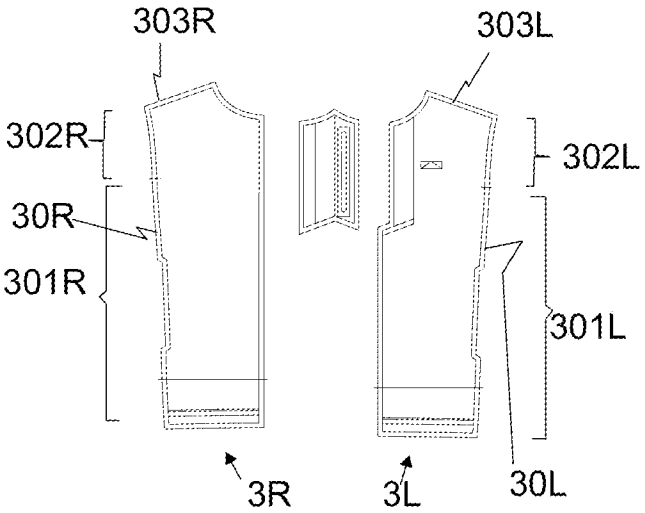
Figure 2A:
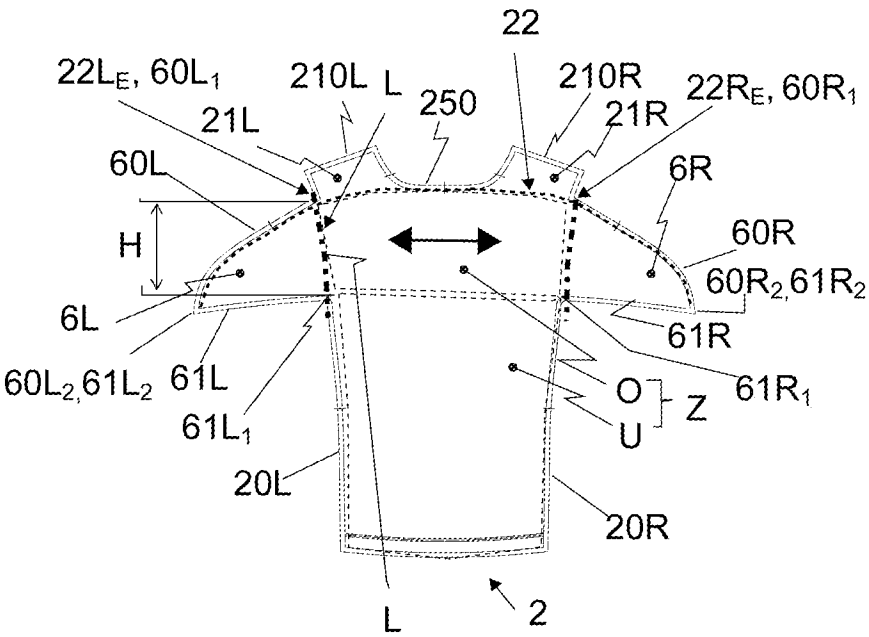
Figure 2C:
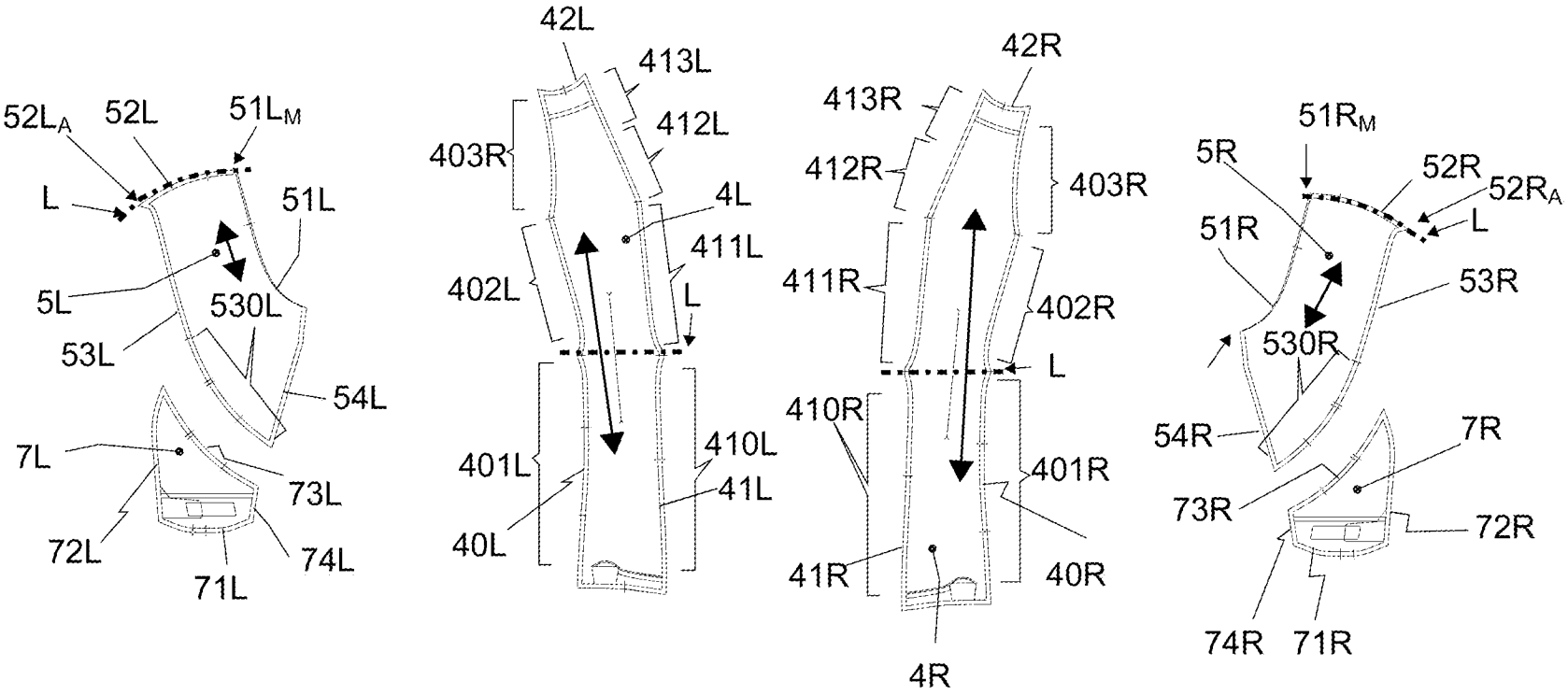

The outer contour of the essential parts of the hunting jacket, i.e. the cut of these parts, are shown in FIGS. 2A to 2C.

In the simplest case, all pieces may be blanks cut from a single layer fabric joined together at their outer edges, as will be explained in more detail below. However, the parts may also be complex half-parts composed of multi-layered blanks with details such as pockets, zippers, reinforcement patches, embellishments or the like. In this sense, the term "part" is therefore not necessarily to be understood as made of a single piece. The individual parts may, as in the case of the front part 3 with the left and right halves 3L and 3R respectively, also be composed of several sub-parts (partial surfaces), unless otherwise indicated.

The hunting jacket is designed as a long-sleeved upper garment 1A, so that it covers substantially the entire torso and arms of a person or wearer and protects the person from the weather.

The 'body' of the hunting jacket is formed by the back part 2, the side parts 4L, 4R, and the two-piece front parts 3L and 3R respectively, which are connected by corresponding longitudinal seams at their respective outer edges.

First, the contour of the back part 2, which is essential for the invention, will be described.

The back part 2 has a central section Z for covering the back—i.e. a lower back as well as a dorsal shoulder neck area of a wearer—which can be divided into an upper and a lower section O and U respectively. The upper section O corresponds approximately to the region of the upper garment which covers a shoulder neck area, i.e. approximately an area between two shoulder blades of the wearer. The lower section U approximately covers the remaining part of the wearer's back. In this embodiment, the upper section and the lower section are made in one piece, i.e. seamless. This allows the number of parts required for the upper garment to be reduced. In an alternative embodiment, however, the upper section O and the lower section U could also be made in two parts and joined together by a horizontal seam.

At the upper section O laterally on the left and right and connected seamlessly are arm sections 6L, 6R, which protrude laterally outwards like wings. The arm sections 6L, 6R are bounded above and below (cranially and caudally) respectively by a top side 60L, 60R and a bottom side 61L, 61R. The start and end of the top sides can be characterised by a laterally inner starting point $60L_1$ and $60R_1$ respectively and a laterally outer end point $60L_2$ and $60R_2$ respectively. Likewise, the start and end of the bottom sides can be defined by a laterally inner starting point $61L_1$ or $61R_1$ and a laterally outer end point $61L_2$ or $61R_2$.

The end points $60L_2$ and $60R_2$ of the top sides 60L, 60R and the end points $61L_2$ and $61R_2$ of the bottom sides 61L, 61R coincide on the left and right respectively. The top side 60L, 60R and the bottom side 61L, 61R are—in contrast to other cuts for upper garments—not parallel and connected at the outer, lateral end by an additional end side, but have a laterally converging top and bottom side.

The starting points $60L_1$, $60R_1$, $61L_1$, $61R_1$ of the top sides 60L, 60R and of the bottom sides 61L, 61R lie in the present embodiment, seen laterally, at approximately the same height, and approximately at the same height as laterally and vertically running boundary lines of the central section Z, here designated as long sides 20L and 20R. The upper starting points $60L_1$ and $60R_1$ are located approximately at the level of the anatomical position of the shoulder joints of the wearer or, equivalently, at a laterally outer end $22L_E$ and $22R_E$ of a left and right shoulder line 22L and 22R, respectively, as shown in particular in FIG. 2A. In other words, the arm sections 6L and 6R, viewed laterally, each start approximately at the height of an armhole, i.e. the transition from the torso covering section of the upper garment 1A to the sleeves, and extend over an entire height H of the upper section O of the back part 2.

The armholes or the edges of the parts forming the armhole are indicated in the figures by the dot-dashed lines L.

The shape of the left and right top side 60L, 60R is curved and slopes outwards and downwards, i.e. convex. The shape of the left or right bottom side 61L, 61R is approximately straight. Top and bottom sides 60L, 60R and 61L, 61R respectively are completely dorsal oriented. The left and right arm sections 6L and 6R respectively are entirely on the back of the upper garment and do not extend ventrally.

Back part 2 is connected to dorsal long sides 41L, 41R of side parts 4L, 4R or their corresponding subsections 410L, 410R up to the level of the armhole (line L) via long sides 20L and 20R, as can also be seen in FIG. 2C. The side parts 4L, 4R are connected via ventral long sides 40L, 40R or corresponding subsections 401L, 401R up to the level of the armhole (Line L) of the left or right side part 4 with the left or right half 3L, 3R of the front part 3 via lower Sections 301L, 301R of the outer sides 30L, 30R of the front part 3L, 3R.

In order to avoid seams at or near the shoulder lines 22L, 22R, a left and a right shoulder flap 21L, 21R respectively are arranged on the back part 2 along the shoulder lines 22L, 22R on the left and on the right of the collar cut-out 250, which extend over the shoulder lines 22L, 22R onto the front side of the upper garment 1A, here up to the level of the anatomical position of a wearer's collar bone. With ventral end sides 210L, 210R, the shoulder flaps 21L, 21R are then connected to collar edges 303L, 303R of the front part 3 located at the upper end.

The hunting jacket is substantially mirror-symmetrical with respect to a sagittal plane, the anatomical median plane, which is why, for reasons of clarity, the suffixes L, R for the left and right sides will be spared in the following for ease of reading. Thus, e.g. the sleeve or the upper arm part 5 represents a left and a right sleeve or upper arm part 5L or 5R respectively.

The sleeve is formed by the arm section 6 of the back part 2, the upper arm part 5, the lower arm part 7 and a distal area of the side part 4, the area above the arm line L of the side part 4, see area with subsections 402 to 403 and 411 to 413 in FIG. 2C.

The upper arm part 5 is formed on four sides with two arcuate and opposing outer edges, namely a first and a third outer edge 51 and 53, and two likewise opposing outer edges, the second and fourth outer edges 52 and 54.

As can be seen in particular from FIGS. 1A and 1B, the upper arm part 5 is cut in such a way that in the upper garment 1A it forms a frontal (ventral) outer arm of the sleeve, extends obliquely in the distal direction and slopes downwards (caudally) onto the back of the upper arm into an elbow region EB, i.e. embraces an elbow of the wearer, and thus forms a textile hinge along the natural bend line of an arm.

The lower arm part 7 is formed on four sides with edges 71 to 74. The edge 71 is arranged opposite the edge 73 and forms a part of a sleeve end of the sleeve of the upper garment 1A. The third edge 73 is concave in shape and is connected to the upper arm part 5 via a distal portion 530 of the third outer edge 53 of the upper arm part 5. The edges 72 and 74 are approximately straight and extend in a proximal-distal direction on a front and back side, respectively, of the sleeve in the region of a forearm.

The area of the side part 4 lying above the armhole line L substantially forms a medially inner part of the sleeve (inner sleeve). The strip-shaped side part 4 forms a lateral flank of the upper garment 1A with a lower area, cf. subsections 401, 410 of long sides 40, 41 up to the armhole line L in FIG. 2C. As the side part 4 extends over the entire length of the upper garment 1A, cross seams in the area of the armhole, which would hinder the freedom of movement of an extremity, can be avoided.

The front and rear long side 40, 41 of the side part 4 can be divided into several subsections in the proximal-distal direction. The front (ventral) long side 40 has subsections 401, 402 and 403. The rear (ventral) long side 41 has the flank section 410, as well as first, second and third rear subsections 411, 412 and 413.

Starting in the proximal-distal direction from the arm hole, the side part 4 is connected at the back (dorsal) via the first subsection 411 to the bottom side 61 of the arm section 6 of the back part 2, via the second subsection 412 to the fourth outer edge 54 of the upper arm part 5 and via the distal subsection or end section 413 to the fourth edge 74 of the lower arm part 7.

On the front side (ventral), the side part 4 is connected in a proximal-distal direction, starting from the armhole, via the second subsection 402 to a subsection of the third outer edge 53 of the upper arm part 5, and via the third end section 403 to the second Edge 72 of the lower arm part 7.

The first outer edge 51 of the upper arm part 5 has a contour adapted to the contour of the top side 60 of the back part 6 and is connected to the top side 60 over the entire length of the top side 60. The second outer edge 52 is rounded and runs along the armhole line L of the upper garment 1B, whereby the second outer edge 52 is connected at the front (with a ventrally located section of the outer edge 52) to an upper end section 302 of the front part 3, the upper collar edge 303, and over the remaining section of the outer edge 52 to the shoulder flap 21.

In the embodiment example, the back part 2, the upper arm part 5 and the side part 4 are manufactured as 2-way stretch material, each with a main stretch direction, as indicated in the figures by the double arrows marking the main stretch direction. The main stretch direction of the back part 2 extends laterally. The main direction of extension of the side part 4 and the upper arm part 5 are each oriented along a longitudinal extension with respect to the long sides 40 and 51 and 53 respectively, cf. FIG. 2C.

Overall, this results in a sleeve with a high degree of freedom of articulation, in which joints or seams are positioned outside of natural movement and flexion lines of an arm or a shoulder, so that the joints or seams cause no or only minimal stiffening along these movement and flexion lines. In the upper garment, vertical joints where the outer edge of one part runs perpendicularly towards the outer edge of another part are also completely avoided, so that force peaks in these joints or connection points are mitigated and can always be divided into different force directions and thus the forces can be broadly distributed over large areas of the upper garment.

Furthermore, the convex shape of the top side 60 of the arm section 6 of the back part 2 means that forces generated when the arm is stretched, which are introduced via the elbow EB into the upper arm part 5 when a forearm is bent sharply, for example, can be distributed over the entire length of the top side 60 of the arm section on an upper arm. Areas of high pressure with a high load on the arm of a wearer can thus be avoided.

Figure 3B:
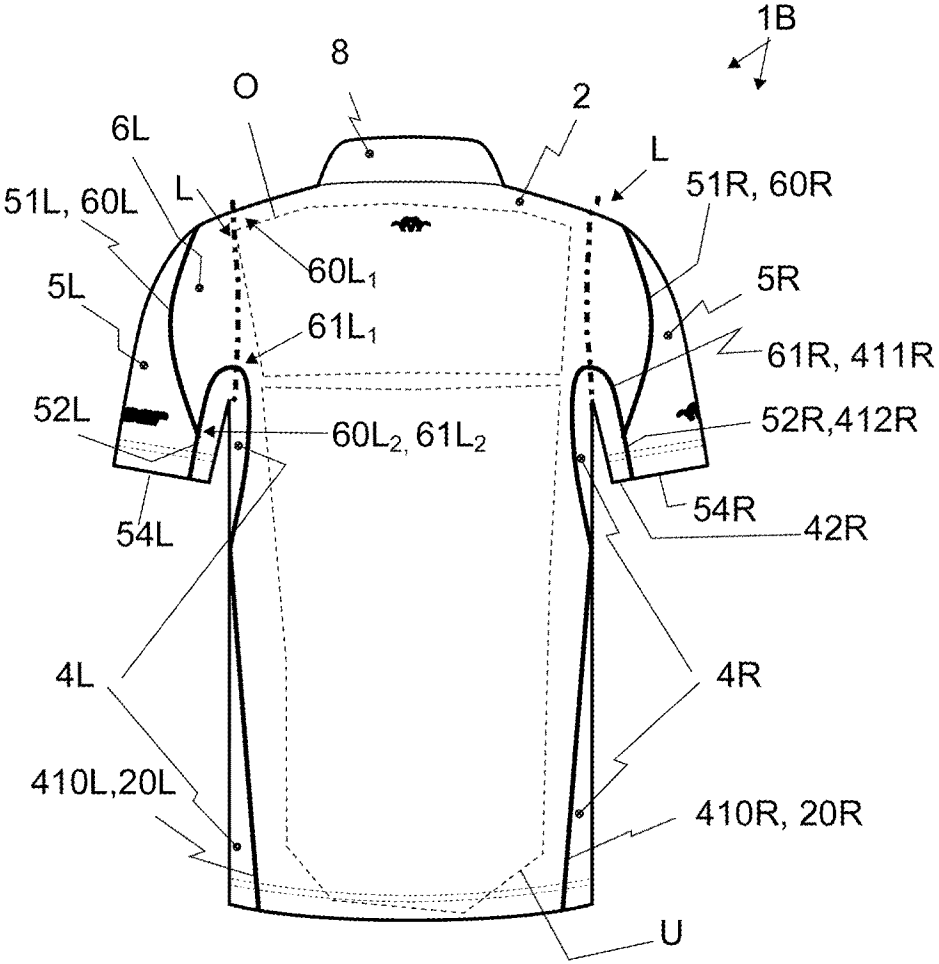
Figure 3A:
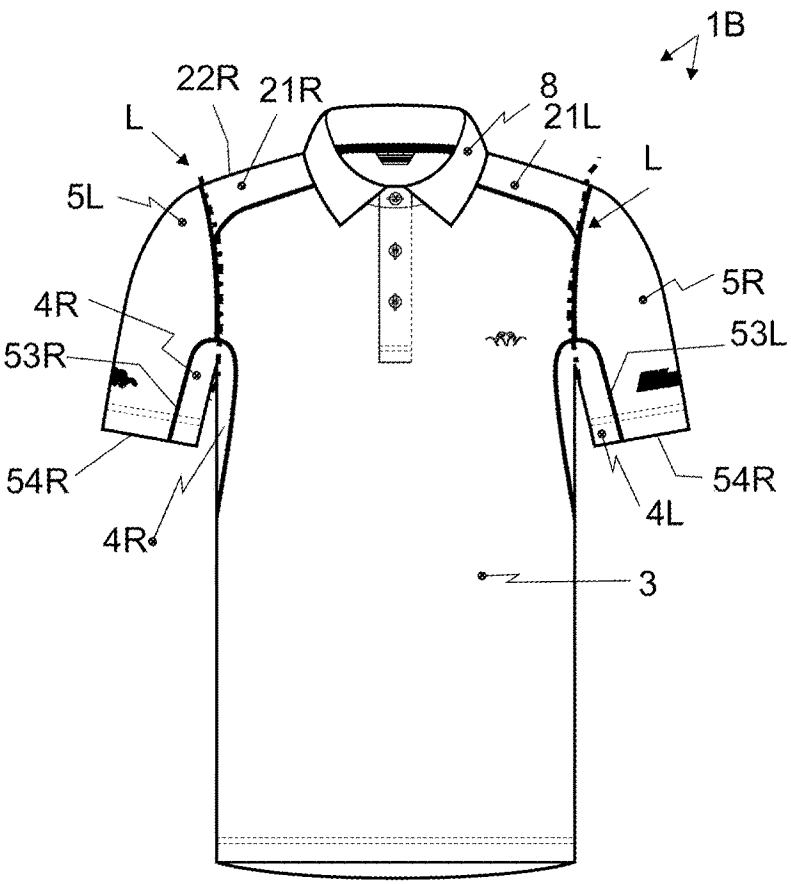

FIGS. 3A and 3B show a second example of an upper garment according to the invention in a front and rear view, respectively. In contrast to the first example of FIGS. 1A to 2C, the outer garment 1B is a short-sleeved polo shirt, i.e. an outer garment. With the exception of the sleeves, the design of the upper garment 1B is comparable to that of the first example, so that in this respect reference can be made to the previous explanations. Obvious differences such as, for example, the one-piece design of the front part 3—without a zip fastener, but instead with a non-continuous button placket-, the absence of pockets or, for example, the use of a single-layer piqué fabric for the parts of the upper garment 1B are conceivable as alternative forms of design. In contrast to the side part 4 of the upper garment 1A, the side part 4 of the upper garment 1B is at the dorsal side, i.e. at the subsections 410 of the longitudinal edges 41, not running vertically in a straight line, but is composed of a partial line tapering outwards and a partial line tapering inwards. The front part 3 is also laterally wider than the front part 3 of the upper garment 1A.

With regard to the sleeve design of the upper garment 1B, the sleeves are substantially-due to the mirror image design, the denotations L and R for the left and right sides are omitted in the description-formed from the arm sections 6 of the back part, the upper arm parts 5 and areas of the side parts 4 lying above an arm hole line L, i.e. the sleeve is designed in three parts. These areas of the side parts form the inner sleeves of the upper garment 1B. The upper arm parts 5 are formed on four sides with four outer edges 51 to 54, whereby on the back side (dorsal) first outer edges 51 are connected to the top sides 60 of the arm sections 6, second outer edges 52 are connected to a distal end section of dorsal long sides of the side parts 4 and on the front side (ventral) third outer edges 53 are connected to distal end sections of front (ventral) long sides of the side parts 4. The fourth outer edges 54 form a sleeve end and, in connection with sleeve ends 42 of the side parts 4, a sleeve band of the sleeves.

This cut allows the sleeves of the upper garment 1B to follow shoulder and arm movements of a wearer with only slight relative displacement of the individual parts with respect to the respective contacting surfaces of the parts contacting the wearer's skin.

The exemplary upper garments 1A and 1B can follow movements of upper extremities very well, allow a high degree of freedom of articulation, offer a high degree of wearing comfort, and can be manufactured in an advantageous manner and at low cost due to a small number of parts.

LIST OF REFERENCE SIGNS

L Armhole line
Z Vertical central section

U Lower section
O Upper section
EB Elbow area
H Height of the upper section O
1A, 1B Upper garment
2 Back part
20L, 20R Long side (left or right)
21L, 21R Shoulder flap (left or right)
210L, R Connection edge of the shoulder flap for the front part
22L, 22R Shoulder line (left or right)
22$L_E$, 22$R_E$ End point of the shoulder line (left or right)
250 Collar cut-out of the back part
3/3L, 3R Front part
30L, 30R Outer side of the front part (left or right)
301L, 301 Lower subsection of the outer side of the front part (left and right)
302L, 302R Upper subsection of the outer side of the front part (left and right)
303L, 303R Collar edge of front part
4L, 4R Side part (left or right)
40L, 40R Ventral long side of the side part
41L, 41R Dorsal long side of the side part
42L, 42R Sleeve end of the side part (left or right)
401L, 401R First subsection of the ventral long side (left or right)
402L, 402R Ventral-proximal subsection (402L, 402R) of the ventral long side (left and right respectively)
403L, 403R Distal end section of the ventral long side (left or right)
410L, 410R First subsection
411L, 411R Second subsection
412L, 412R Third subsection
413L, 413R Distal end section of the dorsal long side
5L, 5R Upper arm part (left and right)
51L, 51R First outer edge of the upper arm part (left and right)
52L, 52R Second outer edge of the upper arm part (left and right)
52$L_A$, 52$R_A$ Caudal end of the second outer edge at the armhole (left and right)
53L, R Third outer edge of the upper arm part (left and right)
54L, R Fourth outer edge of the upper arm part (left and right)
6L, 6R Arm sections (left and right)
60L, 60R Top side (left and right)
61L, 61R Bottom side (left and right)
60$L_1$, 60$R_1$ Starting point of the top side (left and right)
61$L_2$, 61$R_2$ End point of the bottom side (left and right)
7L, 7R Lower arm part (left and right)
71L, 71R First edge of lower arm part section (left and right), sleeve end
72L, 72R Second edge of the lower arm part (left and right)
73L, 73R Third edge of the lower arm part (left and right)
74L. 74R Fourth edge of the lower arm part (left and right)
8 Collar
9 Hood

What is claimed is:

1. An upper garment composed of several parts comprising a front part, a left and a right side part, a left and a right upper arm part, and a one-piece back part, wherein the one-piece back part has a vertically extending central section and laterally extending left and right arm sections, the left arm section having a top side for connection to the left upper arm part and a bottom side for connection to the left side part, and the right arm section having a top side for connection to the right upper arm part and a bottom side for connection to the right side part, wherein each of the top sides and each of the bottom sides of the left and right arm sections is an outer edge of the one-piece back part for connection to an outer edge of another part of the upper garment, wherein each of the arm sections extends in a respective lateral direction and is configured to cover a substantial part of a respective upper arm of a wearer of the upper garment, wherein the top sides of the left and right arm sections each comprise a lateral inner starting point and a lateral outer end point, and the bottom sides of the left and right arm sections each comprise a lateral inner starting point and a lateral outer end point, wherein the lateral outer end point of the top side of the left arm section coincides with the lateral outer end point of the bottom side of the left arm section, and the lateral outer end point of the top side of the right arm section coincides with the lateral outer end point of the bottom side of the right arm section, wherein the left upper arm part and the right upper arm part at least partially form left and right sleeves, respectively, wherein the left arm section and the right arm section extend to at least partially form the left and right sleeves, respectively, and, wherein the bottom sides of the left arm section and the right arm section are configured to extend in a distal-dorsal direction up to and terminating at an elbow region of the left and right sleeves, respectively.

2. The upper garment of claim 1, wherein the central section of the one-piece back part comprises a lower region having left and right substantially vertically running long sides for covering a back of the wearer and an upper region for covering a shoulder neck portion of the wearer, the arm sections being disposed laterally on the upper region.

3. The upper garment of claim 1, wherein the lateral inner starting points of the top sides of the left and right arm sections of the one-piece back part are configured to be located substantially at outer end points, respectively, of left and right shoulder lines of the upper garment.

4. The upper garment of claim 1, wherein the top sides of the left and right arm sections each lie dorsal and have an arcuate course.

5. The upper garment of claim 1, wherein the top sides of the left and right arm sections each have a convex course.

6. The upper garment of claim 1, wherein the bottom sides of the left and right arm sections each have a substantially rectilinear course.

7. The upper garment of claim 1, wherein the one-piece back part has left and right shoulder flaps for connection to the front part, the left and right shoulder flaps respectively being between the left and right arm sections and a collar cut-out of the one-piece back part, and the left and right shoulder flaps being configured to extend ventrally forward over left and right shoulder lines respectively to cover shoulders of the wearer.

8. The upper garment of claim 1, wherein the front part has a lateral left and a lateral right long side, wherein each of the right and left side parts has a ventral and a dorsal long side, wherein a first subsection of the ventral long side of each of the side parts extending to a respective armhole line is connected to a lower subsection of a respective lateral long side of the front part, wherein a first subsection of the dorsal long side of the side part extending to an armhole line is connected to a respective long side of the one-piece back part, wherein the left and right upper arm parts each have a first outer edge, the first outer edge being connected to the top side of the left and right arm sections respectively, wherein the left and right upper arm parts each have a second outer edge which is attached to a laterally inner end of the first outer edge, the second outer edge being connected to a subsection of the outer side of the front part, wherein the left and right upper arm parts each have a third outer edge which adjoins the other, caudal end of the second outer edge, and wherein the third outer edge extends ventrally and is connected to a ventrally-proximally extending subsection of the ventral long side of the side part, so that the left and right upper arm parts are configured to, respectively, embrace an outer side of a left and right upper arm of the wearer.

9. The upper garment of claim 8, wherein the upper garment is a long sleeved upper garment wherein the left and right sleeves are left and right long sleeves, respectively, each of the long sleeves comprising an inner medial inner-sleeve and an outer lateral outer-sleeve, wherein each of the side parts is longitudinally elongated such that each of the side parts extends to a sleeve end and forms an entirety of a respective inner medial inner-sleeve, with each of the outer-sleeves being formed by a respective upper arm part, a respective arm section of the one-piece back part and a respective lower arm part, each respective lower arm part having a first, a second, a third, and a fourth edge, wherein the first edge of the lower arm portion forms a sleeve end which together with the sleeve end of the side part forms a sleeve band, wherein the second edge of the lower arm portion is connected to a distal end section of the ventral long side of the side part, wherein the third edge of the lower arm portion is connected to a distal subsection of the third outer edge of the upper arm part, wherein the fourth edge is connected to a distal end section of the dorsal long side of the side part, and wherein the upper arm part has a fourth edge connected to a subsection of the long dorsal side of the side part.

10. The upper garment of claim 8, wherein each of the upper arm parts is configured to extend from a proximal end to a distal end of each of the upper arms and simultaneously winds from a ventral side to a distal side of the upper garment in such a way that each of the upper arm parts is configured to cover a respective bicep, elbow region, and outer forearm of the wearer.

11. The upper garment of claim 8, wherein the upper garment is a short sleeved upper garment wherein the left and right sleeves are left and right short sleeves, respectively, each short sleeve comprising an inner medial inner-sleeve and an outer lateral outer-sleeve, with the right and left inner-sleeves being formed respectively from the side part, the right and left outer sleeves being formed respectively from the upper arm part and the arm section of the one-piece back part, and wherein the right and left upper arm parts each have a fourth outer edge opposite the first outer edge, which together with the sleeve end of the side part forms a sleeve band.

12. The upper garment of claim 1, wherein at least one of the parts is made of a 2-way stretch material or a 4-way stretch material.

13. The upper garment of claim 12, wherein the 2-way stretch material or the 4-way stretch material is a mechanical stretch material, elastic properties of which are substantially not affected by the material elasticity of threads used in the material, but by mechanical crimping of threads used in the material.

14. The upper garment of claim 1, wherein each of the arm sections is configured to extend in a lateral direction so as to cover at least ⅓ of a length of the respective upper arm of the wearer.

15. The upper garment of claim 1, wherein the lateral outer end points of the bottom sides of the left and right arm sections each lie on a back side of the respective upper arm of the wearer at a distal length that is configured to be at least ⅓ of a length of the respective upper arm of the wearer.

16. The upper garment of claim 1, wherein a seam is formed along the top side and the bottom side of each of the left and right arm sections.

17. The upper garment of claim 1, wherein none of the lateral outer end points of the bottom sides of the left and right arm sections is located substantially at an armhole line of the upper garment.

* * * * *